United States Patent [19]

Belanger

[11] 4,229,843

[45] Oct. 28, 1980

[54] POOL FLOOR

[75] Inventor: Germain Bélanger, St. Germain de Grantham, Canada

[73] Assignee: Bombardier Limited, Quebec, Canada

[21] Appl. No.: 925,753

[22] Filed: Jul. 18, 1978

[51] Int. Cl.[3] ..... E04H 3/16; E04H 3/18

[52] U.S. Cl. ..... 4/495; 4/499; 4/501

[58] Field of Search ..... 4/172.13, 172, 172.11, 4/172.19, 172.12, 172.14, 171

[56] References Cited

U.S. PATENT DOCUMENTS

| | | | |
|---|---|---|---|
| 3,423,768 | 1/1969 | Glenn | 4/172.13 |
| 3,813,704 | 6/1974 | Troiano | 4/172.13 |
| 3,871,033 | 3/1975 | Bartlett | 4/172.13 |
| 3,955,797 | 5/1976 | Richards | 4/172.13 |
| 4,008,497 | 2/1977 | Badon | 4/171 |

FOREIGN PATENT DOCUMENTS

| | | | |
|---|---|---|---|
| 1929826 | 12/1969 | Fed. Rep. of Germany | 4/172.13 |
| 2548574 | 5/1976 | Fed. Rep. of Germany | 4/172.13 |
| 6807035 | 11/1969 | Netherlands | 4/172.13 |

*Primary Examiner*—Henry K. Artis

*Attorney, Agent, or Firm*—Larson, Taylor and Hinds

[57] ABSTRACT

An adjustable flooring structure for swimming pools is formed by a series of large, flat, panel-like modules interconnected to form a floor. The structure includes ballasting means formed by serially connected pipes in the modules which pipes can be filled with water or air to alter the buoyancy of the structure as desired. The structure is supported from the pool floor on adjustable legs and without the legs has a low overall height so that it can be settled to the bottom of the pool when not required for use.

15 Claims, 15 Drawing Figures

FIG. 6
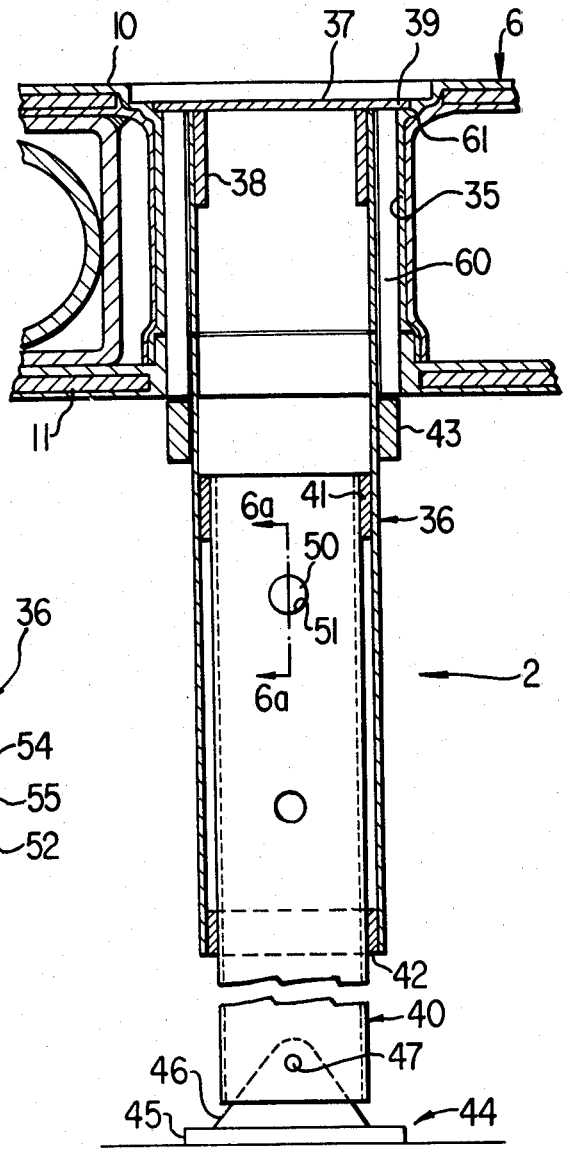
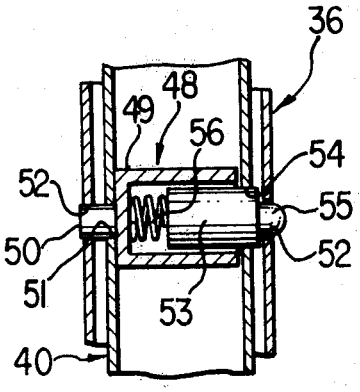
FIG. 6a

POOL FLOOR

BACKGROUND OF THE INVENTION

1. Field of the Invention

This invention relates to flooring structures for use in swimming pools, and also to an improved flooring structure module which can be assembled in various combinations to provide a swimming pool flooring structure of desired size.

2. Description of the Prior Art

Since the construction costs of swimming pools, and in particular large swimming pools of say 50 meter length, is very great, and represents a substantial capital investment, most cities and towns are striving for better general use of such facilities. The 50 meter pools used for international swimming competition are required to have a minimum depth of approximately 6 feet, and because of this depth such pools are of limited use for general public swimming, and in particular are unsuitable for use by young children. For this reason proposals have been made to provide such pools with floors of adjustable height in at least one section of the pool so that the depth of water in that section can effectively be reduced to a level which is safe for use by young children. However, such adjustable floors as have hitherto been proposed are generally very expensive to install and maintain and require considerable modification of the floor structure of the pool. Furthermore, because of their complexity, such adjustable floor structures almost always have to be installed at the time of construction of the pool since the modifications required to install such structures in existing pools render the cost prohibitive. An additional problem associated with the installation of such structures in existing pools is that they are generally of substantial height so that even when they are lowered to the inactive position at the bottom of the pool, there may still not be sufficient depth of water above the adjustable flooring structure to satisfy depth requirements.

SUMMARY OF THE INVENTION

It is an object of the invention to provide a module for use in a raised flooring structure for a swimming pool which can be readily installed either in new or existing swimming pools, requires virtually no structural modification of the pool, and can be installed without emptying the water from the pool.

The invention provides a module for use in a raised flooring structure for a swimming pool comprising: a top panel of relatively rigid material presenting a generally flat upper surface; ballasting means carried on said panel and operative selectively to adjust the specific gravity of the module to be greater or less than that of water; and coupling means on said module adapted to form a releasable connection between said module and at least one adjacent similar module in a horizontal plane.

Preferably the ballasting means comprises a series of serially connected pipes positioned on the underside of the panel, said pipes being interconnectable between adjacent modules in the assembled flooring structure. Thus the flooring structure may be submerged or floated by filling the pipes with water or air respectively. The volume of the pipes in relation to the density of the overall flooring structure is preferably selected to be such that when the pipes are filled with water, the overall flooring structure has a small negative buoyancy, and will settle down into the water of the pool, to be supported at a selected height above the pool floor on legs. Preferably such legs are removable in which case the flooring structure when not in use can be allowed to settle right to the bottom of the pool. The flooring structure can be constructed with a relatively small overall thickness, e.g. 6 inches, so that when settled on the bottom of the pool, there may still be a sufficient depth of water within the pool. Thus it becomes possible to prepare the pool for competitive swimming events without the necessity of disassembling and removing the flooring structure from the pool.

The module is preferably formed by two co-extensive rectangular panels of bonded fiberglass construction, with ballast pipes sandwiched between the upper and lower panels. The flooring structure may include removable leg means which can be inserted through apertures from the upper side of the module, and locked in position to support the flooring structure at the desired height. The legs are preferably adjustable in length so that the height of the flooring structure may be varied. With this arrangement adjustment of the flooring structure becomes very quick and convenient. If the flooring structure lies in the inoperative position at the bottom of the pool, it is only necessary to connect air lines to the pipes within the modules, and to pump in air to displace the water. When the pipes are filled with air the buoyance of the flooring structure will cause it to rise and float on top of the pool. The buoyancy in this condition need not be very great, but preferably will be sufficient to support the weight of the workers who are to install the legs. Thus the specific gravity of the flooring structure may be between 1.0 and 1.1, preferably 1.05. The legs, suitably adjusted as to length, can then be installed in the modules, and the ballasting pipes can be refilled with water, whereupon the entire flooring structure will settle back into the pool to the predetermined height until the legs come to rest on the bottom of the pool. The flooring structure preferably has only a slight negative buoyancy when the pipes are filled with water so that it does not impose any excessive load upon the floor of the pool.

In the preferred embodiment described herein, the flooring structure incorporates several sections of open grillwork panels. At one end of the flooring structure a large grill is pivoted and forms a ramp which bridges the height between the flooring structure and the pool floor. The flooring structure is formed in two sections separated by a longitudinal central grill area, and a continuous peripheral grill area is positioned between the walls of the swimming pool and the edges of the flooring structure. These various grill areas facilitate water circulation within the pool when the flooring structure is installed, and most importantly, provide means to accommodate displacement of water from one side of the flooring structure to the other when the floor is being raised or lowered. Without such grills, the time required to raise or lower the floor would be excessive.

The modules are preferably provided in standard rectangular sizes and can be interconnected to provide flooring structures of various overall dimensions. Means may be provided to support a grill work structure around the edges of the flooring structure, and by varying the dimensions of such grill work, the flooring structure can be readily tailored in size to match the dimensions of the pool in which it is to be installed.

DESCRIPTION OF THE DRAWINGS

The invention will further be described, by way of example only, with reference to the accompanying drawings wherein:

FIG. 6 is a vertical sectional view illustrating the mounting of a support leg;

FIG. 6*a* is a fragmentary sectional view taken on the line 6*a*—6*a* in FIG. 6;

DESCRIPTION OF THE PREFERRED EMBODIMENT

Figure 1:
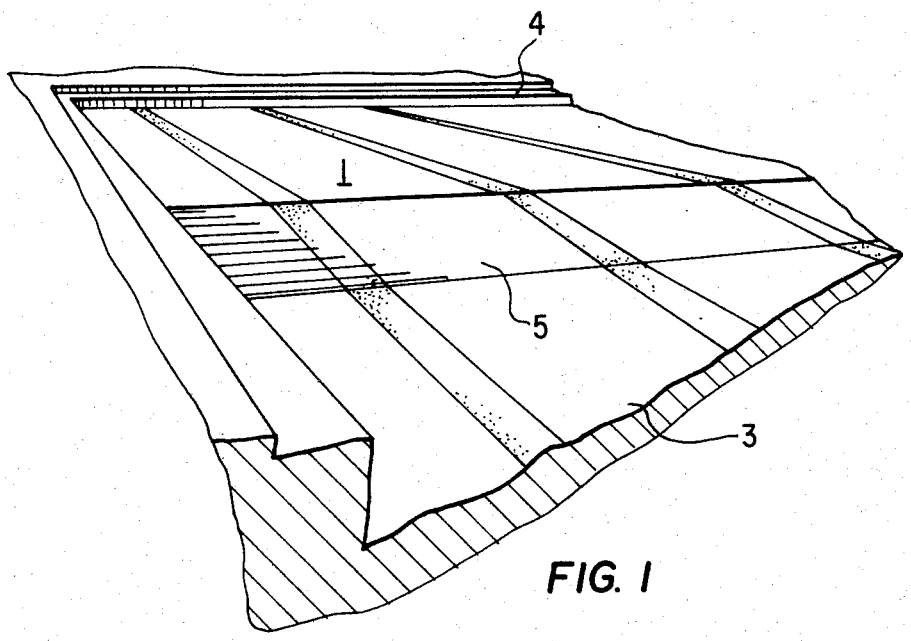
FIG. 1 is a partial perspective view of the improved flooring structure as mounted in a swimming pool.
Figure 2:
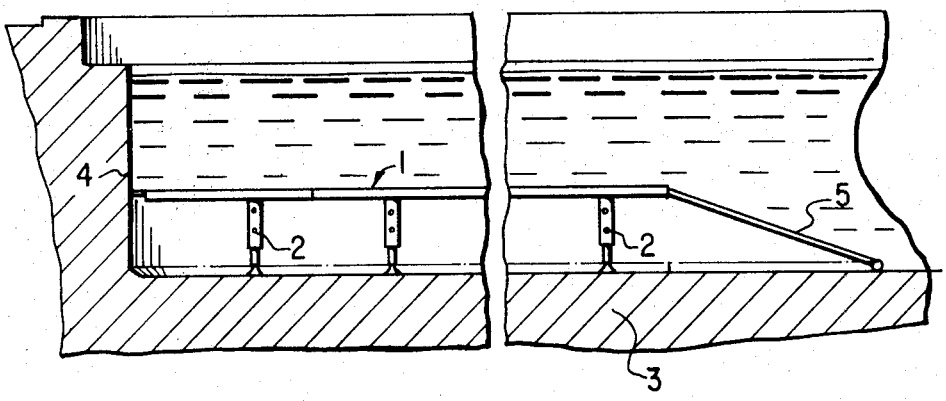
FIG. 2 is a sectional view of the pool showing the flooring structure in operational position.
Figure 3:
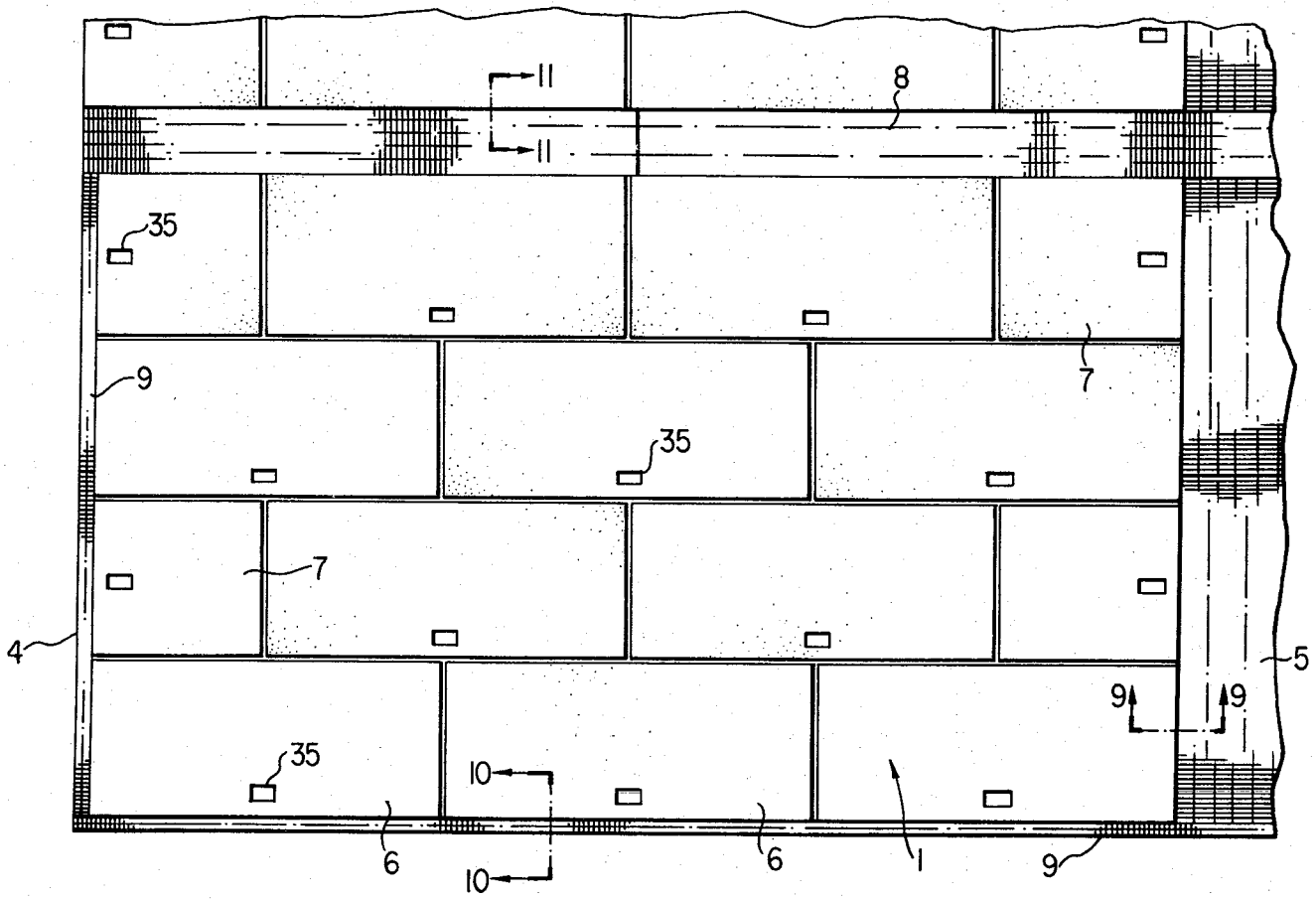
FIG. 3 is a fragmentary plan view of the flooring structure illustrating the arrangement of the modules.

Referring to FIGS. 1, 2 and 3, a flooring structure generally indicated at 1 is shown installed in a swimming pool. The flooring structure is positioned at one end of the swimming pool and extends entirely across its width, and for a suitable distance, e.g. 60 feet, from that end. As seen in FIG. 2, the flooring structure is supported on a series of leg assemblies 2 above the bottom 3 of the pool, one edge of the structure abutting the end wall 4 of the pool, and the other end supporting a large grill structure 5 which forms an inclined ramp bridging the height between that end of the flooring structure and the bottom of the pool.

As seen in FIG. 3, the flooring structure comprises a series of full size modules 6 and half size modules 7 interconnected in a horizontal plane. The modules 6 and 7 may be of any convenient size, in the illustrated example, the modules 6 being approximately 22 feet by 9½ feet, and the modules 7 being approximately 11 feet by 9½ feet. In addition to the ramp like grill 5, the flooring structure includes a central grill area 8 and a peripheral grill area 9, the latter being positioned between the periphery of the flooring structure and the walls of the pool. As will be explained herein, the grill areas 8 and 9 facilitate water circulation when the flooring structure is installed as shown in FIG. 2, and facilitate movement of the flooring structure from the operational to the non-operational position. By suitable selection of the dimensions of the grill areas, it becomes possible to adapt the modules 6 and 7 to form a flooring structure to fit a pool of almost any size.

Figure 4:
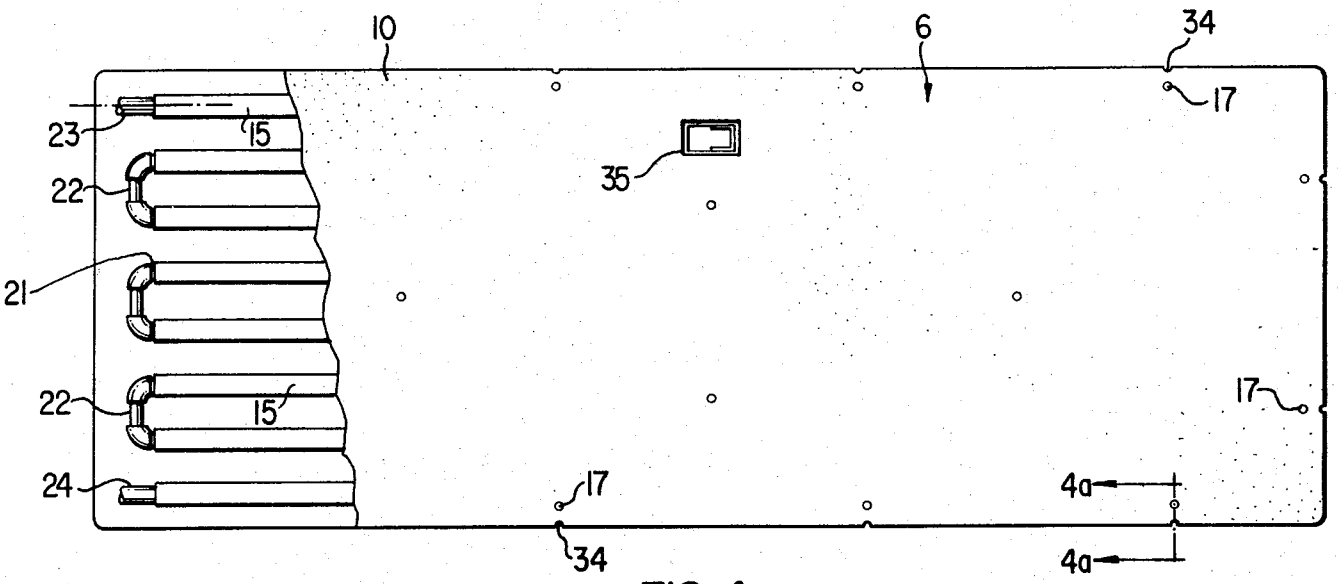
FIG. 4 is a plan view to an enlarged scale showing a single module, partially sectioned to illustrate the interior structure.
Figure 5:
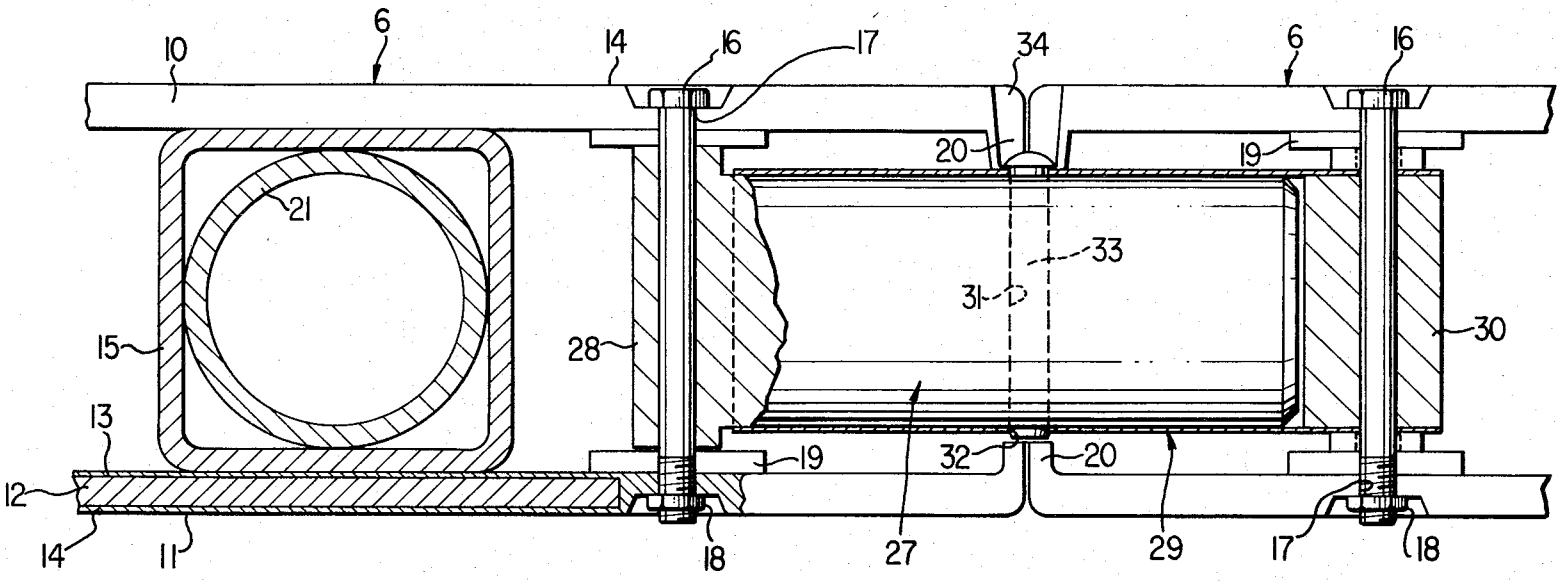
FIG. 5 is an enlarged sectional view illustrating the interconnection of the modules.

Referring now to FIGS. 4 and 5, the structure of a full size module 6 is illustrated, it being understood that, except for its dimensions, the half size module 7 is of essentially the same composition. The module 6 comprises two extensive composite rectangular upper and lower panels 10 and 11 respectively. The structure of each panel is substantially identical, and as can be seen in FIG. 5 consists of a light-weight core panel 12 of balsa wood sandwiched between inner and outer layers 13 and 14 of resin bonded glass fibre material. This produces a very strong lightweight construction, and of course the outer layer 14 of the upper panel 10 can be textured as desired to provide a non-slip surface, can be pigmented to match the colour of the bottom of the pool in which the flooring is to be installed, and, as seen in FIG. 1, can be marked to include the lane markings, commonly provided on the floors of swimming pools.

The sandwich structure as described above is important in achieving a module structure having the desired degree of buoyancy. The buoyancy will of course depend upon the thickness of the balsa wood core panel 12, and this thickness is selected accordingly. It is desirable that the module except for the ballasting means has only a relatively small negative buoyancy since this means that the volume of the ballasting means can be kept to a minimum. It will be understood that the larger the volume of the ballasting means, the greater must be the pumping capacity to empty or fill the ballasting means in a given time, or alternatively, for a given pumping capacity the greater the length of time required.

Figure 4A:
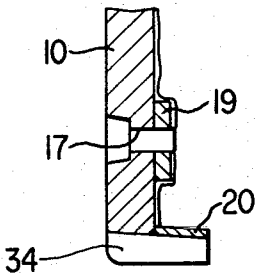
FIG. 4*a* is an enlarged sectional view taken on the line 4*a*—4*a* in FIG. 4.

Referring to FIGS. 4 and 5, between the upper and lower panels of the module 6 is sandwiched an array of parallel rectangular glass fibre spacer tubes 15. As shown in FIG. 4, eight such tubes are provided uniformly spaced across the width of the module 6, and extending almost from end to end of the module. In the embodiment illustrated, the spacer tubes 15 are of square section having a dimension of four inches, the upper and lower panels 10 and 11 each being approximately one inch in thickness, so that the overall thickness of the module 6 is approximately 6 inches. The spacer tubes 15 are bonded to the lower panel 11, the panels being interconnected by a series of threaded fasteners in the form of bolts 16 pass through aligned holes 17 spaced around the peripheries of the upper and lower panels and engaged by nuts 18 on the underside of the lower panel. The holes 17 are countersunk so that the bolt heads do not project above the surface of the upper panel 10. In the region of the holes 17, the edges of the upper and lower panels are strengthened by aluminum or stainless steel stiffening plates 19 bonded to the inner surface of the panel (see FIG. 4*a*). The edges of the panels 10 and 11 are rounded, and terminate in a short lip 20 which projects inwardly of the module.

Figure 4B:
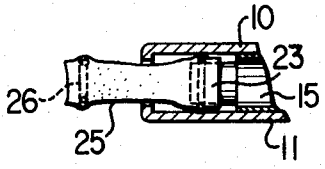
FIG. 4*b* is a sectional view to an enlarged scale taken on the line 4*b*—4*b* in FIG. 4.

As shown in FIG. 4, each module 6 includes ballasting means formed by a series of pvc pipes 21 which are serially interconnected by coupling means 22 to form a continuous path through the module from an inlet connection 23 to an outlet connection 24. FIG. 4*b* shows how in the assembled flooring, the inlet connection 23 can be coupled to the outlet connection (not shown) of the tubing in an adjacent module, by the use of a short length of flexible pvc piping 25 carrying O-ring sealing means 26. The ends of the connector pipe 25 are simply pushed over the inlet 23 and the outlet in the adjacent panel so that the O-ring seal 26 seals against the external surface of the pipe.

In the assembled flooring structure the modules 6 and 7 are interconnected by coupling means which are best illustrated in FIG. 5. A male coupling part is provided by a rectangular section tongue 27 having a boss 28 at one end and through which the bolt 16 is passed to secure the tongue to the module. The tongue therefore is pivotally supported on the bolt 16, and projects laterally of the module as shown. A complimentary female coupling part is provided by a rectangular section tubular socket 29 having a boss 30 which is similarly pivotally supported on a bolt 16 at the edge of an adjacent module 6. Vertically oriented holes 31 and 32 are provided in the tongue and tubular socket respectively so that when the tongue is inserted into the socket and the holes 31 and 32 are aligned, the adjacent modules can be interconnected by a pin 33 inserted through the aligned holes, the head of the pin being accommodated in a circular recess 34 formed one half in each of the modules. The coupling thus formed is very easily disconnected by withdrawing the pin 33 and moving the tongue 27 and socket 29 out of engagement. As will be seen from FIG. 4, provision for such coupling is provided at four locations along the longitudinal edge of each full size module 6, and at two locations along the transverse edge.

Figure 8:
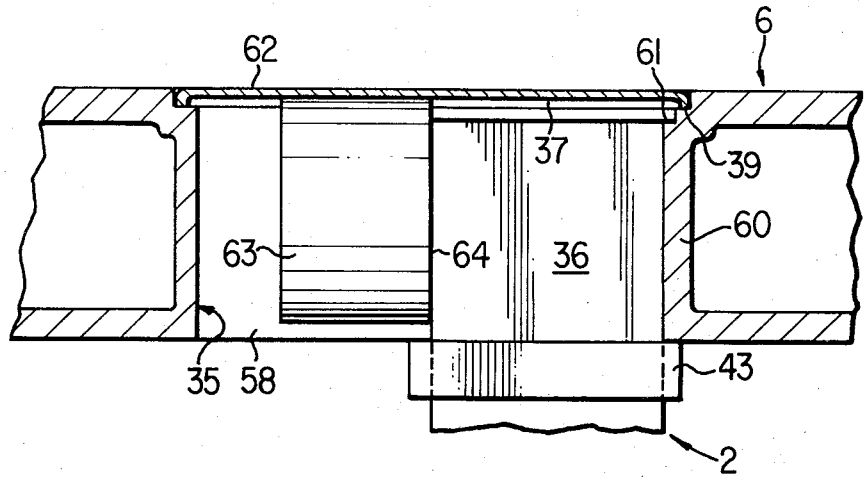
FIG. 8 is a sectional view taken in a vertical plane at right angles to that of FIG. 6, illustrating the leg secured in position.
Figure 7:
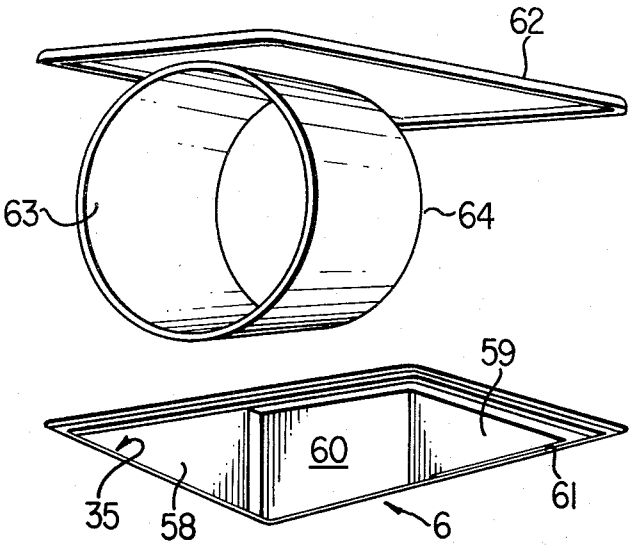
FIG. 7 is a perspective view illustrating the means for retaining the support leg in the module.

As has been referred to above, the flooring structure when in the installed position, shown in FIG. 2 in full lines, is supported at a predetermined spacing above the floor of the pool upon a series of leg assemblies 2. The leg assemblies are supported in leg support apertures 35 in the modules 6 and 7, and as indicated in FIG. 3, there is one such aperture in each module. The structure of the leg assemblies and their mounting arrangements are best shown in FIGS. 6 to 8 of the drawings. Referring to FIG. 6, each leg assembly comprises an upper hollow rectangular aluminum leg section 36 the upper end of which is closed by a top plate structure 37 having walls 38 received within the leg section 37 and secured thereto as by riveting, and a flange 39 which overhangs the wall of the leg section 36 on three sides. The top plate 37 preferably includes apertures (not shown) forming gripping means whereby the leg can be manipulated. Telescopically received within the upper leg section 36 is a lower leg section 40 of similar profile, the leg sections being spaced apart, and guided for relative telescoping movement by a collar 41 carried at the lower end of the upper leg section 36, and a collar 42 carried at the upper end of the lower leg section 40.

On the external surface of the upper leg section 36 is carried an abutment collar 43 which is spaced from the flange 39 by a distance corresponding to the thickness of the module 6. At the bottom of the lower leg section 40 is a foot 44 formed by a flat plate 45 having upwardly extending lugs 46 received within the lower leg section and pivotally connected thereto on a pin 47. As shown in FIG. *6a*, the lower leg section 40 carries detent means generally indicated at 48 and comprising a cylindrical cup 49 having an integral cylindrical pin 50 projecting from one end therefrom through an aperture 51 in the lower leg section 40 into engagement with a registering aperture 52 in the upper leg section 36. Within the cylindrical cup 49 is a plunger 53 which extends through an aperture 54 and carries a central pin which is received in an aligned aperture 52 in the upper leg section. The pins 50 and 55 are urged apart by a coiled compression spring 56 acting between the cup 49 and the plunger 53.

Spaced longitudinally of the opposed apertures 52 in the upper leg section is a further pair of aligned apertures 57 sized to receive the pins 50 and 55 of the detent means 48.

As will be apparent from the foregoing, the leg assembly 2 is extensible between two positions of adjustment, although obviously more positions of adjustment could be provided if so desired. In the position shown in FIG. 6, the pins 50 and 52 of the detent means 48 are in engagement with the upper pair of apertures 51 in the upper leg section 36, and the leg is of its smaller length. In this condition, the pins 50 and 55 are urged apart into engagement with the apertures 51, and transmit to the metal surrounding these apertures any weight load imposed upon the leg assembly. To adjust the length of the legs, it is sufficient merely to apply manual pressure to the pins 50 and 55 to depress them inwardly out of engagement with the apertures 51, whereupon the lower leg section 40 is free to be telescoped downwardly and outwardly of the upper leg section 36 until the pins 50 and 55 become aligned with the lower pair of apertures 57 whereupon the pressure of the spring 56 will cause these pins to be thrust outwardly into engagement with the apertures 57. The leg sections are dimensioned in relation to the location of the holes 57 that when the collars 41 and 42 come into abutment, the pins 50 and 55 are registered with the apertures 57. Similarly, the lower ends of the walls 38 of the top plate 37 are designed to provide an abutment with the upper edge of the lower leg section 40 to locate the pins 50 and 55 in registration with the upper pair of apertures 51. Thus the leg assembly 2 can be moved between its two positions of adjustment in a highly reliable and very simple manner.

Each leg assembly 2 is designed to be located within one of the apertures 35 in a module 6 or 7. As best seen in FIG. 7, the aperture 35 is of rectangular shape having an enlarged section 58 at one side and at the other side a smaller section 59 which is defined by a projecting wall 60 extending over approximately half of the length of the two long sides of the aperture 35, and across one short side, thereby defining a horizontal ledge 61 spaced below the top surface of the upper panel 10 of the module. The enlarged section 58 of the aperture 35 is dimensioned such that the leg assembly can be inserted downwardly therethrough until the collar 43 passes beneath the under-surface of the lower panel 11. The dimensions are so chosen however that the flange 39 at the top of the leg cannot pass through the enlarged section 58. This avoids the possibility that the leg might slip completely through the aperture and require a diver for its retrieval from the pool floor. Once inserted, the leg can be moved laterally into the small section 59 of the aperture 35, and in this position the leg is located and secured in the vertical direction, at the upper end the flange 39 abutting against the ledge 61, and at the lower side of the panel the collar 43 abutting against the marginal area of the lower panel 11 surrounding the small section 59 of the aperture 35. Thus the weight of the module 6, and any load supported thereby, is transmitted to the leg assembly 2 through the collar 43. As shown in FIG. 7, a closure plate 62 is provided to close off the upper end of the aperture 35 once the leg has been installed. The closure plate is of glass fibre construction and carries a retainer means to secure the leg assembly 2 in engagement with the reduced section 59 of the aperture 35. As shown in FIG. 8, the retainer means comprises a tubular spring element 63 affixed to the underside of plate 62 with its axis parallel to the length of the aperture 35. The element 63 is of glass fiber, being of resilient construction and having in the free state a diameter somewhat larger than the width of the enlarged section 58 of the aperture 35. Accordingly, when the leg assembly 2 has been installed and moved to the engaged position in the small section of the aperture 35, the closure plate 62 can be positioned as shown in FIG. 8, insertion of the tubular spring element 63 into the enlarged section 58 of the aperture 35 causing this element to be compressed and to form a frictional engagement with the walls of the aperture. When installed, as shown in FIG. 8, the end edge 64 of the spring element 63 abuts the lateral wall of the upper leg section 36, and accordingly prevents movement of the leg assembly 2 out of the small section 59 of the aperture 35, thus retaining the leg securely in the assembled condition. Upon removal of the closure plate 62, when the leg assembly 2 is unweighted, it can readily be moved laterally into the enlarged section 58 of the aperture 35 and withdrawn therefrom.

Figure 9:
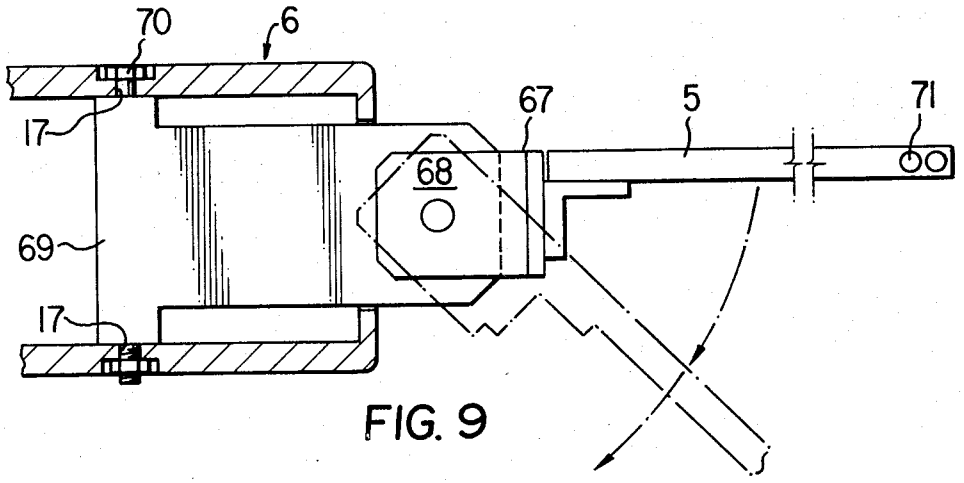
FIG. 9 is a fragmentary sectional view taken on the line 9—9 in FIG. 3.

As seen in FIGS. 1 and 2, at one end of the flooring structure 1 is a large, inclined, open-work grill panel 5 which forms a ramp between the bottom 3 of the swimming pool and the flooring structure 1 when the latter is supported on the leg assemblies 2 as shown in FIG. 2 of the drawings. The grill 5 comprises a series of rectangular panels of open-work grill structure supported on brackets 67 (FIG. 9) pivotally attached on pins 68 carried in mounting plates 69 secured to the ends of the modules 6 and 7. The mounting plates 69 are similar in construction to the male coupling parts 27, and are mounted to the modules 6 and 7 by bolts 70 passed through the aligned holes 17 in the upper and lower panels. Accordingly, the grill ramp 5 can be pivoted as a unit from the horizontal position shown in full lines in FIG. 9, to an inclined position as shown in broken lines. To control pivotal movement of the grill 5 ballast means 71 may be provided adjacent the free edge of the grill. These ballast means are in the form of pipes similar to the pipes 21 in the modules, and capable of being placed in communication with the pipe system of the modules.

Figure 10:
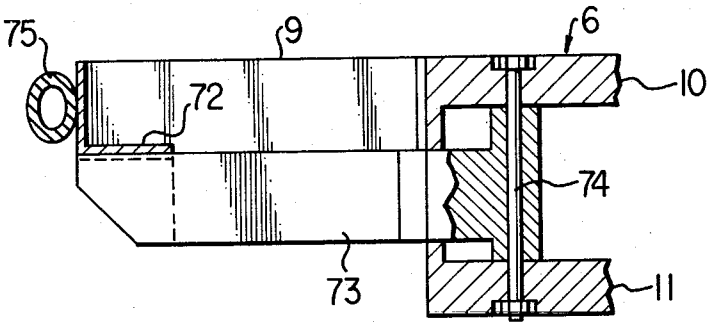
FIG. 10 is an enlarged fragmentary sectional view taken on the line 10—10 in FIG. 3.

The structure of the peripheral grill area 9 may be seen from FIG. 10. The grill 9 is supported in angle brackets 72 extending longitudinally thereof and supported on mounting plates 73 extending laterally from the edge of the modules 6 and 7. The mounting plates 73 are similar to the male coupling parts 27 previously described, and in like manner are supported on bolts 74 passing through the apertures 17 in the upper and lower panels 10 and 11 respectively. The grill 9 is of a width to match the dimensions of the flooring structure to the dimensions of the pool, and carries on its peripheral edge a flexible sealing means 75 which contacts the wall of the pool.

Figure 11:
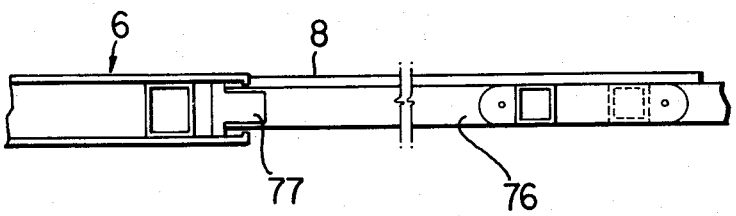
FIG. 11 is a fragmentary sectional view taken on the line 11—11 in FIG. 3.

As shown in FIG. 3, the flooring structure includes a longitudinally extending central grill area 8 arranged between two sections of modules. The support structure for the central grill area 8 is illustrated in FIG. 11 and comprises a hollow tubular frame work 76 supported on mounting plates 77 carried on the edges of the modules 6 and 7 in a manner similar to the mounting plates 69 and 73 described above.

The above described flooring structure is of relatively simple construction and has the great advantage that it can be installed in an existing swimming pool with virtually no modification of the pool. The flooring structure can in fact even be assembled quite simply without removing the water from the pool. To assemble the structure, the inlets 23 and outlets 24 of the pvc piping 21 in each module are simply closed by temporary plugs (not shown) and the modules placed in the water. Since the piping 21 is full of air, the modules are buoyant, and float on the surface of the pool. The modules 6 and 7 are then assembled together by means of the couplings previously described. During assembly, the temporary plugs are removed from the inlets and outlets of the piping 21, and the pipes of the various modules are serially interconnected by means of the connector pipes 25 previously described. The central grill areas 8 edge grill areas 9, and grill ramp 5 are then attached, so that the complete flooring structure can be assembled floating on top of the water in the pool.

Figure 12:
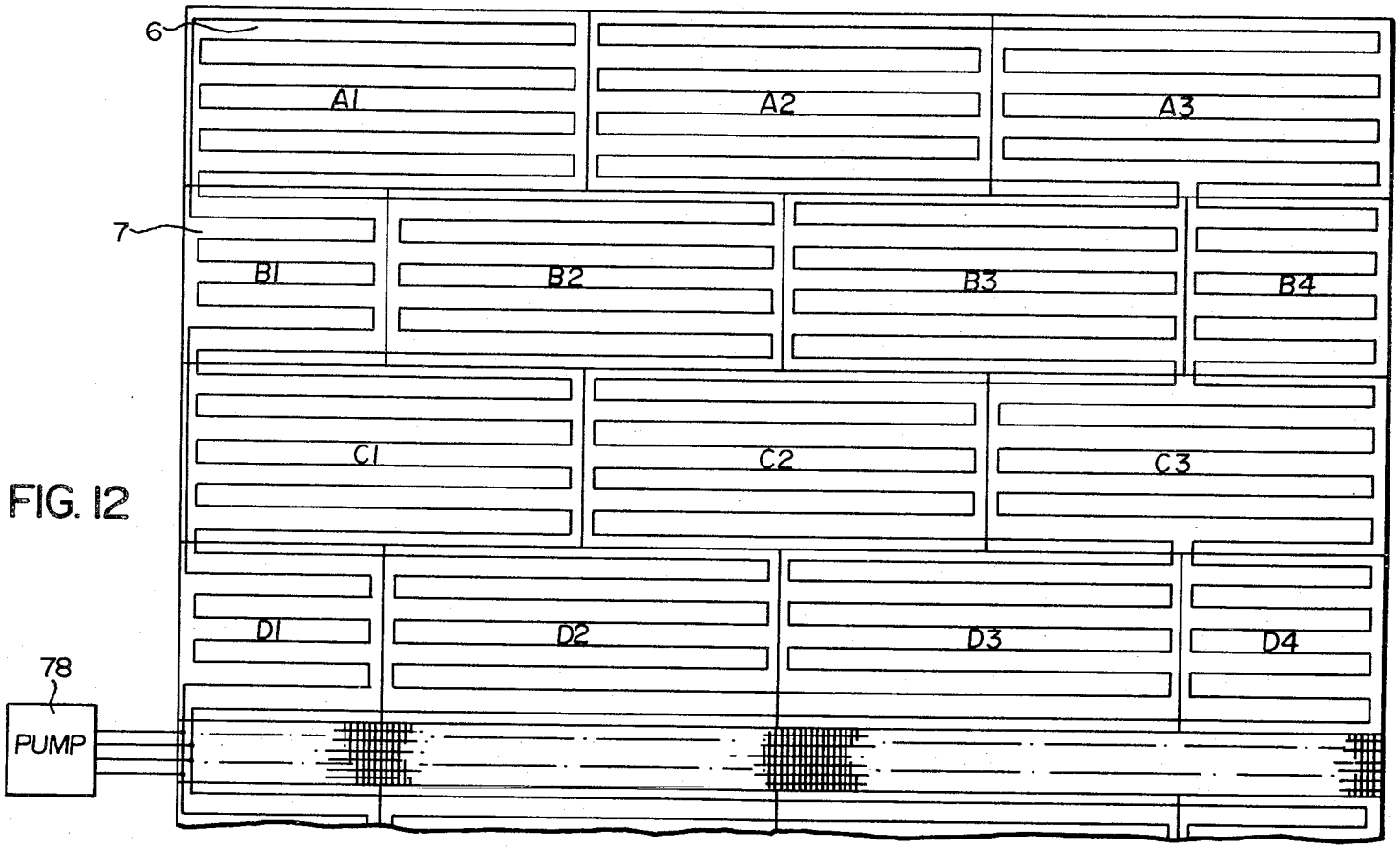
FIG. 12 is a partial plan view illustrating the interconnection of the ballasting means of the modules of the flooring structure.

The manner in which the pipes 21 of adjacent modules 6 and 7 in one half of the flooring structure are interconnected is diagrammatically illustrated in FIG. 12, the other half of the flooring structure being arranged in similar manner.

In FIG. 12 of the drawings, the modules are arranged in rows, and identified by the designations A1, A2, A3; B1, B2, B3, B4; . . . It will be seen that the pipes 21 of the various modules are successively interconnected generally transversely of the flooring. Thus with the assembled flooring structure floating on the surface of the pool, the pump 78 is operated to commence filling the pipes 21 with water. Water from the pump is first delivered to the module D4, and when the ballast pipe 21 in this module is filled, the water then fills the ballast pipe of module C3. As will be apparent from FIG. 12, the ballast pipes of the modules are filled in the order D4, C3, A3, B3, C2, D3, B2, C1, B2, A1, B1, D1. Thus when the ballast pipes are being filled with water, the right-hand end of the flooring structure as seen in FIG. 12 will be the first to submerge so that as the flooring structure is submerged it will be slightly tilted towards the right-hand end, thus reducing the likelihood of entrapment of air within the ballast pipes of the modules. Such tilting also assists water circulation or displacement during raising or lowering of the flooring structure. The density of the modules is selected such that when the pipes are filled with water, the flooring structure has a small negative buoyancy. The negative buoyancy is selected to be of a sufficiently low level that the flooring structure when submerged by displacing air from the ballasting pipes will settle in a slow and stable fashion, and it will not exert excessive pressure upon the bottom of the pool.

If prior to submersion of the flooring structure the leg assemblies 2 have been installed, then the flooring structure will settle until the feet 44 come to rest upon the bottom of the pool so that the structure will be supported at a desired predetermined height above the bottom of the pool. Due to the small negative buoyancy of the flooring structure, only a small number of leg assemblies 2 are required. In the embodiment illustrated, only one leg assembly per module is necessary, even although the modules are very large.

When it is desired to alter the setting of the leg assemblies to change the height of the flooring structure within the pool, or when it is desired to remove the leg assemblies altogether, it is a simple matter to operate the pump 78 to displace the water from the ballasting pipes 21, and thus to cause the flooring structure to float slowly to the surface of the water in the pool. In this condition, workers may walk on the surface of the floating structure and remove the closure plates 62. The leg assemblies may then (since they are unweighted) be moved easily to the enlarged section 58 of the corresponding aperture and withdraw therefrom. If the flooring structure is to be reset at a different height, then the leg assemblies are adjusted accordingly by manipulation of the spring loaded pins 52 and 55, and thereupon reinserted into the apertures 35 and locked in place by the closure plates 62. The flooring structure may then be resettled into the pool by operation of the pump 78 to fill the ballasting pipes 21 with water.

It will be appreciated that if the flooring structure is not required for use, there is no need to disassemble it and to remove it from the pool. Instead, the entire structure may be submerged until it rests upon the floor of the pool in the position shown in broken lines in FIG. 2. To move the flooring structure to this position, it is first floated by pumping in air to the ballasting pipes 21. Once floating on top of the water, the leg assemblies 2 are removed entirely, and the ballasting pipes filled with water to cause the flooring structure to settle right to the floor of the pool. For the embodiment described, the flooring structure in the submerged position in no way interferes with the use of the pool for competitive swimming. The embodiment described has an overall thickness of only about 6 inches so that in a pool having a water depth of 2 meters, even without removing the flooring structure from the pool, there is still a depth of water of in excess of 6 feet when the flooring structure is fully submerged on the bottom of the pool.

Details of the flooring structure may of course be modified to suit particular applications. Although in the embodiment described and illustrated the modules 6 and 7 are composed primarily of glass fibre material, various other suitable materials will occur to those skilled in the art. The coupling means, fasteners, support brackets, etc. may be fabricated in any suitable non-corrosive material, and may conveniently be of aluminum or aluminum alloy, or stainless steel. Alternatively the leg assemblies themselves may be of glass fibre construction.

The interconnection of the pipes 21 in the modules 6 and 7 will not in all cases be the same as is shown in FIG. 4, but on the contrary will be varied to suit the overall ballasting system of the structure to provide suitable tilting of the floor, as will be apparent from consideration of the layout shown in FIG. 12.

Although the flooring structure described above extends across the full width of the swimming pool, it will be understood that it could be made narrower if desired. For example in a 50 meter pool, if the flooring structure were only half the pool width, there would still be several swimming lanes of full 50 meter length unimpeded by the flooring structure.

The presence of a flooring structure as described above does not unduly impede cleaning of the pool. When the flooring structure is supported on its legs the grill ramp 5 can be raised and the pool floor can be cleaned by the conventional robot cleaning machine, which is not hampered by the small number of leg assemblies. Alternatively the entire flooring structure can be raised and floated to the other end of the pool.

Where the pool floor 3 is uneven or inclined, it is still possible to arrange for the flooring structure to be supported horizontally in the pool by suitable selection of the lengths of the leg assemblies 2. In this case the leg assemblies will not be interchangeable but each will be associated with a particular location in the pool. To accommodate the tilting action, the free end of the ramp grill 5 and the first row of leg assemblies are preferably supported on rollers.

What I claim as my invention is:

1. An adjustable flooring structure for a swimming pool comprising:

a planar platform having a flat upper side and a lower side;

a plurality of legs each engageable in an operative position with said platform to extend downwardly therefrom and to support said platform in a horizontal disposition at a predetermined height above the floor of a swimming pool;

buoyancy adjusting means mounted on said platform and selectively operable to cause said platform to float to the surface of the water in the pool or to sink towards the floor of the pool;

said legs being accessible from the upper side of said platform to effect movement thereof to and from said operative position, said platform being capable of resting with its lower side in contact with the pool floor when said legs are removed from the operative position and said buoyancy adjusting means operated to cause the platform to sink.

2. A flooring structure according to claim 1 wherein said buoyancy adjusting means comprises a series of pipes distributed throughout the area of said platform and serially interconnected, and means for selectively supplying air or water to the interior of said pipes.

3. A flooring structure according to claim 1 wherein said legs are of adjustable length to vary the height at which the platform is supported.

4. A flooring structure according to claim 1 wherein for each leg there is a corresponding aperture in said platform through which the leg can be inserted from the upper side, means being provided to form a releasable connection between the leg and the parts defining said aperture to retain the leg in the operative position.

5. A flooring structure according to claim 4 wherein each said leg carries a collar near its upper end, said aperture having a first section sized to accommodate passage of said leg and collar therethrough, and an adjacent second section sized to receive said leg but prevent passage of said collar, such that said leg can be inserted into said first section until the collar moves beneath the lower side of said platform and then moved laterally into said second section wherein said collar abuts the underside of said module, and further comprising means to retain said leg in said second section of the aperture.

6. A flooring structure according to claim 5 in which said retaining means is a blocking member carried by a lid which is insertable in the upper end of said aperture to form a closure therefor having a top surface substantially co-planar with the upper surface of said top panel, means being provided to releasably retain said lid in engagement with said aperture.

7. A flooring structure according to claim 6 wherein said blocking member comprises a resilient tubular element attached to said lid and arranged such that when said leg is positioned in said second section of said aperture and said lid is added, the tubular element is positioned in said first section of said aperture to block movement of said leg, said tubular element having in the unstressed condition a width greater than the width of said first section but being compressible for insertion into said first section to frictionally engage the sides of said first section of the aperture and thereby releasably retain said lid.

8. A flooring structure according to any of claims 1, 2 and 4 to 6 wherein each said leg is of adjustable length, having relatively extensible upper and lower sections and detent means adapted to form a releasable coupling therebetween at pre-determined positions of adjustment, said detent means comprising a spring-loaded pin carried in one leg section and selectively engageable with each of a plurality of longitudinally spaced apertures in the other leg section.

9. A flooring structure according to any of claims 1 to 7 further comprising a peripheral grill member adapted to be attached along opposite edges of the platform to form horizontal extensions of the upper surface thereof, said grill members being designed to bridge between the sides of the platform and the walls of the pool and facilitate circulation of water between upper and lower sides of the platform.

10. A flooring structure according to any of claims 1 to 7 further comprising a grill panel adapted to be pivotally attached along one edge of the platform so as to provide an inclined ramp to bridge the height between the bottom of the pool and the platform when the latter is supported on its legs above the pool floor, and a peripheral open work grill panel adapted to be attached along at least one other edge of the platform to form a horizontal extension of the upper surface thereof, said grill panels facilitating circulation of water between opposite sides of the platform when the flooring structure is installed in a pool.

11. A flooring structure according to claim 1 wherein said platform comprises a plurality of modules each comprising: a top panel of relatively rigid material presenting a generally flat upper surface and coupling means adapted to form a releasable connection between said module and at least one adjacent similar module in a horizontal plane.

12. A flooring structure according to claim 11 wherein said buoyancy adjusting means comprises chamber means attached to said top panel and adapted to be filled selectively with water or air, said chamber means being provided by a series of pipes positioned on the underside of said panel, the pipes of adjacent modules being serially interconnected in the assembled condition of the platform.

13. A flooring structure according to claim 12 wherein each module includes a base panel substantially co-extensive with said top panel and means inter-connecting said panels, each of said top and base panels being of bonded glass fibre construction said panels being spaced on opposite sides of a series of tubular spacing members.

14. A flooring structure according to claim 13 wherein in each module the pipes extend within said tubular spaces, and wherein the means interconnecting said top and base panels also provide a mounting for said coupling means.

15. A flooring structure according to any of claims 11 to 14 wherein one said leg is provided for each module, each said module having an aperture accessible from the upper side of said top panel and through which said leg can be inserted, and means to form a releasable connection between said leg and said module in the region of said aperture, said aperture being closed by a lid which is flush with the upper surface of the platform and is effective to retain the associated leg in its operative position.

* * * * *